United States Patent [19]

Boenisch

[11] Patent Number: 4,664,171

[45] Date of Patent: May 12, 1987

[54] COLD BOX PROCESS FOR PRODUCING MOLD PARTS

[76] Inventor: Dietmar Boenisch, Morillenhang 45, 5100 Aachen, Fed. Rep. of Germany

[21] Appl. No.: 674,076

[22] Filed: Nov. 23, 1984

[30] Foreign Application Priority Data

Nov. 23, 1983 [DE] Fed. Rep. of Germany ..... 3342225

[51] Int. Cl.[4] ..... B22C 1/22; B22C 9/12

[52] U.S. Cl. ..... 164/16; 164/228

[58] Field of Search ..... 164/12, 16, 228, 338.1; 249/79, 80

[56] References Cited

U.S. PATENT DOCUMENTS 2,619,702 12/1952 Blackburn et al. ..... 164/338.1 X 2,887,741 5/1959 Sabel ..... 164/338.1 X 3,550,673 12/1970 Gallagher et al. ..... 164/228

4,051,886 10/1977 Ross ..... 164/228 X 4,068,703 1/1978 Dunlop ..... 164/228 X

*Primary Examiner*—Nicholas P. Godici

*Assistant Examiner*—J. Reed Batten, Jr.

*Attorney, Agent, or Firm*—Michael J. Striker

[57] ABSTRACT

Mold parts are produced in accordance with a cold box procedure with passing a gaseous catalyst during curing, wherein for improvement of the application characteristics before/during curing, a gradient of properties within the mold part is caused such that the resistance of the surface layer of the mold part is increased relative to the resistance of the interior of the mold part.

4 Claims, 2 Drawing Figures

COLD BOX PROCESS FOR PRODUCING MOLD PARTS

BACKGROUND OF THE INVENTION

The present invention relates to a method of producing mold parts in accordance with the cold box process, as well as to a mold part and a molding tool.

Mold parts of synthetic resin bound silica hereinbelow referred to as casting molds, include the mold parts having cores inserted therein and are an important basis for the mass production of high quality castings. Various manufacturing processes differ from one another in the type of synthetic resin used and their catalytic curing. The catalysis is performed either by heating or at room temperature by adding a catalyst. Heat curing manufacturing processes are known under the names of hot box, warm box and thermoshock processes. These processes, however, have been increasingly replaced by cold curing processes since they provide for the advantage in energy saving and improved working conditions. In addition, the manufacture of mold parts can be carried out in plastic mold tools.

It is known that the molded parts produced in accordance with various processes and also in accordance with the cold box process are provided after the formation of the mold parts with a layer on their sides which forms a mold cavity. The application and drying a layer require additional working operations and also a waiting time till casting of the casting mold and thereby sufficient time for drying the layer.

In the area of cold curing, the so-called cold box method has achieved a high degree of importance worldwide. Very high production outputs are obtained on automatic production lines. This method uses polyurethane as a binder. The starting components for use now are isocyanate and a phenolic resin, however, other binder combinations are also possible. They are mixed with silica sand in ratio of approximately 1–2 parts by weight. The thus produced molding material is introduced into the mold tool in automatic production of casting molds and immediately after this is cured in a cold tool by passing a catalyst gas, usually dimethylethylamine.

From technical and economical reasons and especially for reducing the environmental impact, the use of lowest possible binder content in the casting practice is desirable, which, however, leads to serious weaknesses of the cold box method.

Cold box binders contain approximately 30–40% of various solvents which are required for low viscosity, high reactivity of the binder, good blowing property of the mold material mixture and adequate strength. These high solvent quantities lead to considerable environmental impacts during processing and pouring off. Lower contents than those mentioned above impair however the strength of the mold parts, especially the mold part surfaces. The edge strength is affected and the mold parts become in their entirety sandy and brittle. Thereby the cold box method loses its usability. Polyurethane-bound mold parts with sufficient solvent and binder contents have good strength immediately after their manufacture. They are however very moisture sensitive and lose their strength within a short time in condition of high air moisture. High air moisture is however, unavoidable in casting. In addition, cold box cores are often treated with water slurry and introduced into wet casting molds thereby are subject to severe moisture damage. This especially impairs the mold part quality since this damage progresses from outside inwardly and thereby affects the especially important mold part surfaces. A highly undesirable strength gradient is produced with low outer strength and high inner strength.

This strength gradient is a disadvantage for a further reason since it makes difficult core destruction after pouring off. Poor core destruction of cold box mold parts is especially dreaded in light metal alloys casting. Remnants of cores are often very difficult to remove from the cold casting and require high fettling costs and extreme working conditions in the fettling shop.

The casting practice made an attempt to counteract the difficulties caused by low surface strength, by increasing binder contents and introduction of coating materials. High binder contents however additionally impair the core destruction since the strength in the interior of the core is increased very high. In addition, moisture damage takes place in the interior of the core to a smaller degree than in the surface layers. Cold box mold parts thus have the serious disadvantage of an undesirable strength distribution. Also their strength increases within 24 hours after the fabrication.

SUMMARY OF THE INVENTION

Accordingly, it is an object of the present invention to provide a method of manufacturing of mold parts, a mold pat and a molding tool which avoids the disadvantages of the prior art.

More particularly, it is an object of the present invention to improve in mold parts manufactured in accordance with the cold box method the strength properties and core destruction at a reduced binder content.

In keeping with these objects and with others which will become apparent hereinafter, one feature of the present invention resides, briefly stated, in a method of manufacturing of polyurethane bound mold parts in accordance with cold box process with mold part curing by impact-like passage of a gaseous catalyst, in which for improving application properties, prior to and/or during curing a property gradient is provided inside the cold box mold part such that the resistance in the surface layer of the mold part is increased relative to that of the interior of the mold part.

When the method is performed in accordance with the present invention, the mold part surface is improved to the depth of several millimeters, but the moisture sensitivity in the interior of the core is retained or even increased and thereby the strength in the course of the core storage in these areas is reduced. As a result of this, the strength and resistance to moisture is increased in the surface layer but reduced in the interior of the core so as to improve simultaneously the core destruction. Because of the surface improvement, lowering of the binder content is possible. This measure lowers the costs, reduces the environmental impact and improves the core destruction.

The inventive method is based on the consideration that the above described disadvantages of the cold box process are based on a cross-linking weakness of the polyurethane molecules caused by the blowing and a very fast cold curing taking place immediately after this. The only weak bonds between the molecule chains can be easily destroyed by water and the mold part strength will be reduced irreparably. The method in accordance with the present invention provides for converting of the polyurethane in the mold part surface into a highly cross-linked form and thereby increases the strength and especially the moisture resistance in the surface layer, but leaves the deeper layers of sand in a weakly cross-linked form.

It is another feature of the present invention to provide a mold part in which the resistance of its surface layer is increased to the resistance of its interior.

It is also an object of the present invention to provide a molding tool which has means for forming a mold part so that the resistance of its surface layer is increased relative to the resistance of its interior.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF PREFERRED EMBODIMENTS

Figure 1:
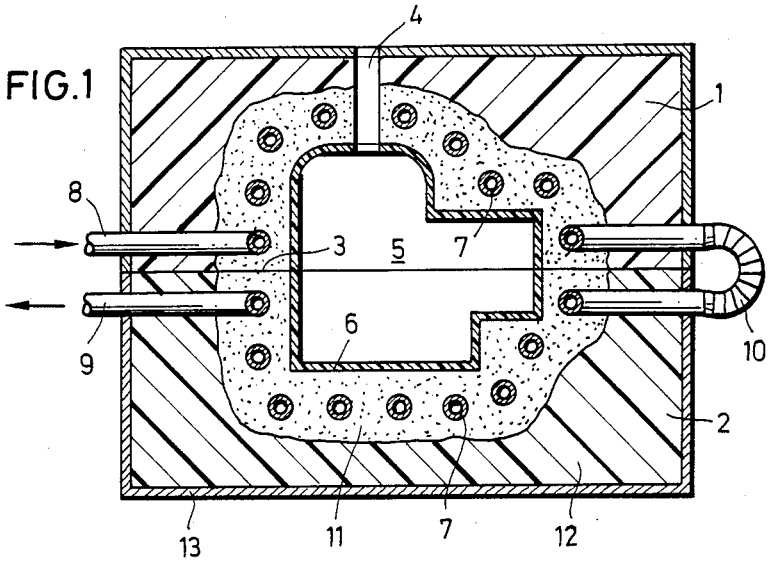
FIG. 1 is a view showing a molding tool of the present invention for performing the inventive method and producing the inventive mold part in a vertical section.

In accordance with the inventive method of manufacturing of polyurethane-bound mold parts with use of a cold box process and mold part curing by impact-like passage of a gaseous catalyst, a property gradient is obtained prior to and/or during curing inside the cold box mold part such that the resistance in the upper layer of the mold part is increased relative to the resistance in the interior of the mold part.

This can be obtained in accordance with the present invention either by a mild heat impulse or by a surface increase in the solvent contents, or by both measures, to form simultaneously or close after one another. Both measures improve the surface quality of the cold box mold parts in a surprising degree.

It has been found that the inventive method can be performed with high efficiency after the blow or shot and shortly before gas curing, since the mold part has already been shaped at this point, but the molecular mobility in still soft molding material is quite high. The inventive method therefore deals with a manufacturing step of the cold box process which has hitherto been passed over carelessly and as rapidly as possible. Improvement measures carried out only after curing of the finished mold component are considerably less effective because of the fixation of the binder structure and in particular cannot be achieved at the low temperatures which characterize the method in accordance with the present invention.

The invention method operates with heated molding tools. Relatively low temperatures of between 30° C. and 150° C., preferably below 100° C. (60°–80° C.) can be used. The uniformity of heating is also of secondary importance. Thus the same molding tool can be hot for example to 50° C. at one point to 80° C. at another point without significant quality differences becoming apparent.

Heating of metallic molding tools can be performed in a known manner by electrical or gas heating. Further possibilities include supplying hot air or guiding the necessary blowing, aerating and purging air through a preheater.

The inventive method is not exchangeable with the conventional hot box and warm box methods and differ from them basically. The conventional methods use the heat for curing and thus require through-heating of the entire mold part cross-section. They operate with significantly higher temperatures between approximately 150° C. and 250° C. and require high temperature uniformity with thermostatic control.

To the contrary, the heat of the invention method does not lead to curing in the heating surface layer. The molding material remains soft and cannot be handled. The inventive method remains a cold method in which the mold part curing is attained unchanged by a gaseous catalyst. The method serves solely to improve extraordinary the efficiency of the gas curing.

The inventive method requires pause between blowing and gas curing of approximately 20–90 seconds, preferably 15–30 seconds. Therefore it is necessary to somewhat lengthen the method course. This pause can be considerably reduced when needed in accordance with a further feature of the present invention, when as mentioned above the solvent contents are increased in the mold part surface. For achieving this, the molding tool in accordance with a further feature of this invention is provided before the blowing with a thin film of a solvent by spraying. The blown molding material absorbs the solvent and provides the desired surface improvement in a shorter time.

The rigid and moisture-resistant mold part surfaces obtained in accordance with the invention method and arrangement makes it possible, in a further embodiment of the invention to use low-solvent binders which now can be proposed for the cold box manufacture. They are recommended particularly for light metal alloys casting.

Low solvent cold box binders tend to loose strength during mold part storage and in addition are especially sensitive to moisture. For these reasons they could not be used up to now. These previous disadvantages remain in the inventive method limited to the interior of the mold parts and act in advantageous manner since the core destruction and also the reusability of the old sand are facilitated. These advantages and the considerable advantages already offered by the possibility of lowering the binder contents are contrasted by an insignificantly lengthened cold box process and the necessity of heating the molding tools.

The relatively low temperature of the inventive method make it possible to use plastic molding tools. Hot water is suitable for tool tempering, whereby the method can be simplified extraordinarily.

In accordance with a further embodiment of the invention, it is proposed to arrange during producing of the molding tool water pipes in a form corresponding to the shape of the pattern in the synthetic resin, through which water pipes hot water continuously flows during the production. It is further proposed to improve the heat transfer between the hot water conduit and the molten tool surface by providing high heat-conductive fillers of metal powder or metal granulate.

The invention is illustrated by the table shown on the following page.

Referring now to the drawing and particularly to FIG. 1 it can be seen that an upper half of the molding tool or corebox is identified with reference numeral 1 and lower part of the molding tool is identified with reference numeral 2. The upper and lower parts are arranged so that a separation plane 3 is formed therebetween. The molding tool is provided with an inlet 4. A mold cavity is identified with reference numeral 5, and the reference numeral 6 identifies a plastic layer with a precise contour. The molding tool has a plurality of pipes 7 for hot water, a water input 8, and a water output 9.

parts, a mold part and a molding tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

| | Test Conditions | | | | | Results | | |
|---|---|---|---|---|---|---|---|---|
| | | | | | | Moisture Sensitivity | | |
| | Binder Level in Molding Material (%) | Solvent Level in Binder (%) | Molding Tool Temp. (°C.) | Exposure Time to Molding Tool Temp. (sec) | Molding Tool Sprayed With Solvent | Surface of Mold Part | Interior of Mold Part | Collapse |
| Conventional Cold Box Process | 1.6 | 33 | 18 | None | no | high | high | fair |
| Example 1 (Only Heat) | 1.4 | 33 | 60 | 30 | no | low | high | improved |
| Example 2 (Heat and Solvent) | 1.3 | 30 | 60 | 20 | yes | eliminated | very high | good |

Figure 2:
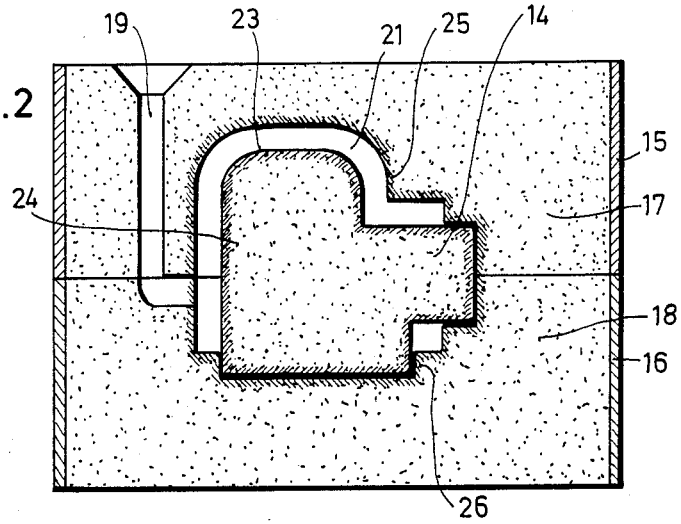
FIG. 2 is a view showing a casting mold in a vertical section.

A flexible hose 10 extends between two halves of the molding tool. It is filled with an aluminum granulate 11 which is available in a compact form in resin-bound sand. A heat-insulating outer jacket 12 is composed, for example, of silica sand bound with synthetic resin. The molding tool has a tool frame identified with reference numeral 13. A core 14 is provided with the molding tool of FIG. 1 and, as illustrated in FIG. 2, suggested in an upper box part 15 and a lower box part 16 in a molding sand 17 and 18 located therein. Reference numeral 19 identifies a gate. Also, a riser can be provided, through which the casting melt can exit upwardly after filling of a mold cavity 21.

FIG. 2 shows that not only a surface 23 of the core 14 has been improved with the molding tool in accordance with FIG. 1. This improvement over a certain layer thickness is identified with a shading 24. This figure also shows that the mold parts 17 and 18 of the upper mold part and lower mold part are each provided with a surface improvement identified with shading 25 and 26.

It should be noted that the improvement obtained in accordance with the invention only needs to be present on the surface of the mold part which limits the mold cavity 21.

It will be understood that each of the elements described above, or two or more together, may also find a useful application in other types of constructions differing from the types described above.

While the invention has been illustrated and described as embodied in a method of producing mold

What is claimed as new and desired to be protected by Letters Patent is set forth in the appended claims:

1. A method of producing a polyurethane-bound mold part in accordance with a cold box process with catalytic curing by a gaseous catalyst, the method comprising the steps of heating a mold part box to a temperature of 30°–150° C.; introducing a molding material mixture containing polyurethane forming constituents into the thus-heated mold part box; introducing a gaseous catalyst into the molding material mixture in the mold part box; and allowing the introduced molding material mixture to stand in the heated mold part box before the introduction of the gaseous catalyst for a time such as to create within a mold part a property gradient such that the strength in the surface layer of the mold part is higher than the strength in the interior of the mold part.

2. A method as defined in claim 1, wherein said heating step includes heating of the mold part box to a temperature of 60°–80° C.

3. A method as defined in claim 1, wherein said allowing step includes allowing the introduced molding material mixture to stand for 20–90 seconds before the introduction of the gaseous catalyst.

4. A method as defined in claim 1, wherein said allowing step includes allowing the introduced molding material mixture to stand for 15–30 seconds before the introduction of the gaseous catalyst.

* * * * *